US006396401B1

(12) United States Patent
Matsuo

(10) Patent No.: US 6,396,401 B1
(45) Date of Patent: May 28, 2002

(54) SHOPLIFTING MONITORING APPARATUS AND ATTACHMENT UNIT

(75) Inventor: Toichiro Matsuo, Arao (JP)

(73) Assignee: Matsuo Sangyo Kabushiki Kaisha, Fukuoka (JP)

( * ) Notice: Subject to any disclaimer, the term of this patent is extended or adjusted under 35 U.S.C. 154(b) by 0 days.

(21) Appl. No.: 09/974,821

(22) Filed: Oct. 12, 2001

(30) Foreign Application Priority Data

Jul. 11, 2001 (JP) ..... 2001-210281

(51) Int. Cl.[7] ..... G08B 13/14

(52) U.S. Cl. ..... 340/568.4; 340/568.1; 340/568.2; 340/571; 340/693.5

(58) Field of Search ..... 340/568.4, 568.1, 340/568.2, 571, 572.1, 572.8, 572.9, 531, 506, 693.5; 200/16 R, 16 C, 19.3, 238

(56) References Cited

U.S. PATENT DOCUMENTS 5,172,098 A * 12/1992 Leyden et al. ..... 340/568.1
5,497,639 A * 3/1996 Charlot, Jr. ..... 70/57.1
5,565,848 A * 10/1996 Leyden et al. ..... 340/572.1
5,570,080 A * 10/1996 Inoue et al. ..... 340/571
6,054,922 A * 4/2000 Smith ..... 340/568.1
6,104,289 A * 8/2000 Rand ..... 340/568.4
6,137,414 A * 10/2000 Federman ..... 340/572.9
6,225,905 B1 * 5/2001 Tyren et al. ..... 340/572.6
6,232,879 B1 * 5/2001 Tyren ..... 340/572.6
6,278,365 B1 * 8/2001 Kane et al. ..... 340/531

* cited by examiner

*Primary Examiner*—Jeffery Hofsass
*Assistant Examiner*—Toan Ngoc Pham
(74) *Attorney, Agent, or Firm*—Rader, Fishman & Grauer

(57) ABSTRACT

Disclosed is a shoplifting monitoring apparatus. The apparatus includes an alarm device and an attachment unit to be attached to an article such that a predetermined attachment surface faces the article. The attachment unit includes a switch for detecting whether or not the attachment unit is attached to the article, and a sleeve member. The switch includes a movable piece and a contact. The contact is in the closed state when the movable piece is located at an inside of a standard position, and is in the open state when the movable piece is located at the standard position or at an outside thereof. The sleeve member has a sleeve portion that surrounds an end portion of the movable piece when the attachment unit is attached to the article. The attachment unit is to be attached to the article such that the movable piece is pushed by the article toward the inside of the attachment surface, and thereby the contact of the switch is in the closed state. Each of the sleeve member and the switch can move in a direction from the inside to outside of the attachment surface and in a reverse direction thereof. The switch moves together with the sleeve member toward the inside of the attachment surface when the sleeve member is pushed toward the inside of the attachment surface. The alarm device issues the alarm at least when the contact of the switch is in the open state.

12 Claims, 8 Drawing Sheets

SHOPLIFTING MONITORING APPARATUS AND ATTACHMENT UNIT

CROSS-REFERENCE TO RELATED APPLICATION

This application is based on Japanese Patent Application No. 2001-210281 filed in Japan on Jul. 11, 2001, the entire content of which is hereby incorporated by reference.

BACKGROUND OF THE INVENTION

1. Field of the Invention

The present invention relates to a shoplifting monitoring apparatus for preventing or deterring an article (monitoring target article) from being shoplifted.

The present invention also relates to an attachment unit that is utilized in the shoplifting monitoring apparatus and to be attached to the monitoring target article.

2. Description of Related Art

A wide variety of shoplifting monitoring apparatus have been proposed for preventing or deterring an article (goods), e.g., on display in a shop, from being shoplifted.

For example, such a shoplifting monitoring apparatus as follows has been proposed. The apparatus is provided with an attachment unit to be attached to the article. The attachment unit includes a switch having a movable piece and a contact that is opened or closed in accordance with a position of the movable piece. An alarm is issued based on the open-closed state of the contact of the switch.

In this shoplifting monitoring apparatus, the alarm is issued when the removal of the attachment unit from the article is detected by the switch. The switch detects whether the attachment unit is attached to the article or not in the following manner. In the switch, the movable piece is supported such that the movable piece can move between an inside and outside of the attachment surface, to be attached to the article, of the attachment unit, and is biased to project outward from the attachment surface. The contact of the switch is in a closed state when the movable piece is pushed toward the inside of the attachment surface, and is in an open state when the movable piece projects outward from the attachment surface due to the biasing force. The attachment unit is to be attached to the article, e.g., with a double-sided adhesive tape, such that the movable piece is pushed toward the inside of the attachment surface, in other words, such that the contact of the switch takes the closed state. When the attachment unit is removed from the article, the movable piece is projected outward from the attachment surface by the biasing force so that the contact of the switch becomes open. According to this, the removal of the attachment unit from the article is detected by the switch. Based on information detected by the switch, the alarm is issued.

In the above shoplifting monitoring apparatus, however, the alarm is not issued if the attachment unit is removed from the article after the movable piece is held not to project outward from the attachment surface by a thin plate, e.g., a cutting knife or a resin plate, inserted between the article and the attachment unit, more specifically, after the movable piece is held such that the contact of the switch does not become open even when the attachment unit is removed from the article. If such malicious act described above is conducted, it will be difficult for a shop staff to notice the shoplifting of the article, and thereby it will be difficult to prevent the shoplifting of the article.

SUMMARY OF THE INVENTION

It is an object of the invention to provide a shoplifting monitoring apparatus which can suppress such a situation that a movable piece of a switch, which is provided for detecting whether an attachment unit is attached to the monitoring target article or not, is held not to move toward an outside of an attachment surface by a thin plate even if the thin plate is inserted between the attachment unit and the article.

It is another object of the invention to provide a shoplifting monitoring apparatus which can issue an alarm before the movable piece of the switch is held, by the thin plate inserted between the attachment unit and the article, not to move toward the outside of the attachment surface.

It is further another object of the invention to provide an attachment unit utilized in the shoplifting monitoring apparatus and to be attached to the article, more specifically to provide the attachment unit which can suppress such a situation that a movable piece of a switch is held not to move toward an outside of an attachment surface by a thin plate inserted between the attachment unit and the article.

It is still another object of the invention to provide an attachment unit which can detect the insertion of the thin plate before the movable piece of the switch is held not to move toward the outside of the attachment surface if the thin plate is inserted between the attachment unit and the article.

(1) SHOPLIFTING MONITORING APPARATUS

The invention provides a shoplifting monitoring apparatus including:

(A) an attachment unit to be attached to an article such that a predetermined attachment surface of the attachment unit faces the article, the attachment unit including:

(A1) a switch provided for;detecting whether the attachment unit is attached to the article or not, the switch including:

(A11) a movable piece biased toward an outside of the attachment surface; and (A12) a contact that is in an open state or a closed state in accordance with a position of the movable piece, the contact being in the closed state when the movable piece is pushed toward an inside of the attachment surface so that the movable piece is located at an inside of a predetermined standard position, the contact being in the open state when the movable piece is located at the predetermined standard position or at an outside of the predetermined standard position; and (A2) a sleeve member having a sleeve portion that surrounds an end portion of the movable piece when the attachment unit is attached to the article, the end portion of the movable piece facing the article when the attachment unit is attached to the article; and (B) an alarm device issuing an alarm based on information detected by the switch; wherein.

the attachment unit is to be attached to the article such that the movable piece is pushed by the article toward the inside of the attachment surface, and thereby the contact of the switch is in the closed state;

each of the sleeve member and the switch is supported such that each of the sleeve member and the switch can move in a direction from the inside toward the outside of the attachment surface and in a reverse direction thereof;

the switch moves together with the sleeve member toward the inside of the attachment surface when the sleeve member is pushed toward the inside of the attachment surface; and the alarm device issues the alarm at least when the contact of the switch is in the open state.

(2) ATTACHMENT UNIT

The invention also provides an attachment unit utilized in a shoplifting monitoring apparatus and to be attached to an article such that a predetermined attachment surface of the attachment unit faces the article.

The attachment unit includes:

(A) a switch provided for detecting whether the attachment. unit is attached to the article or not, the switch including:

(A1) a movable piece biased toward an outside of the attachment surface; and (A2) a contact that is in an open state or a closed state in accordance with a position of the movable piece, the contact being in the closed state when the movable piece is pushed toward an inside of the attachment surface so that the movable piece is located at an inside of a predetermined standard position, the contact being in the open state when the movable piece is located at the predetermined standard position or at an outside of the predetermined standard position; and (B) a sleeve member having a sleeve portion that surrounds an end portion of the movable piece when the attachment unit is attached to the article, the end portion of the movable piece facing the article when the attachment unit is attached to the article; wherein the attachment unit is to be attached to the article such that the movable piece is pushed by the article toward the inside of the attachment surface, and thereby the contact of the switch is in the closed state;

each of the sleeve member and the switch is supported such that each of the sleeve member and the switch can move in a direction from the inside toward the outside of the attachment surface and in a reverse direction thereof; and the switch moves together with the sleeve member toward the inside of the attachment surface when the sleeve member is pushed toward the inside of the attachment surface.

The foregoing and other objects, features, aspects and advantages of the present invention will become more apparent from the following detailed description and the accompanying drawings.

BRIEF DESCRIPTION OF THE DRAWINGS

FIG. 2(A) shows the attachment unit when an external force except for a predetermined biasing force does not act on a movable piece of a switch and a sleeve member. FIG. 2(B) shows the attachment unit when the movable piece is pushed toward an inside of an attachment surface. FIG. 2(C) shows the attachment unit when the switch is pushed together with the sleeve member toward the inside of the attachment surface.

DESCRIPTION OF THE PREFERRED EMBODIMENTS

§1. SHOPLIFTING MONITORING APPARATUS

Figure 1:
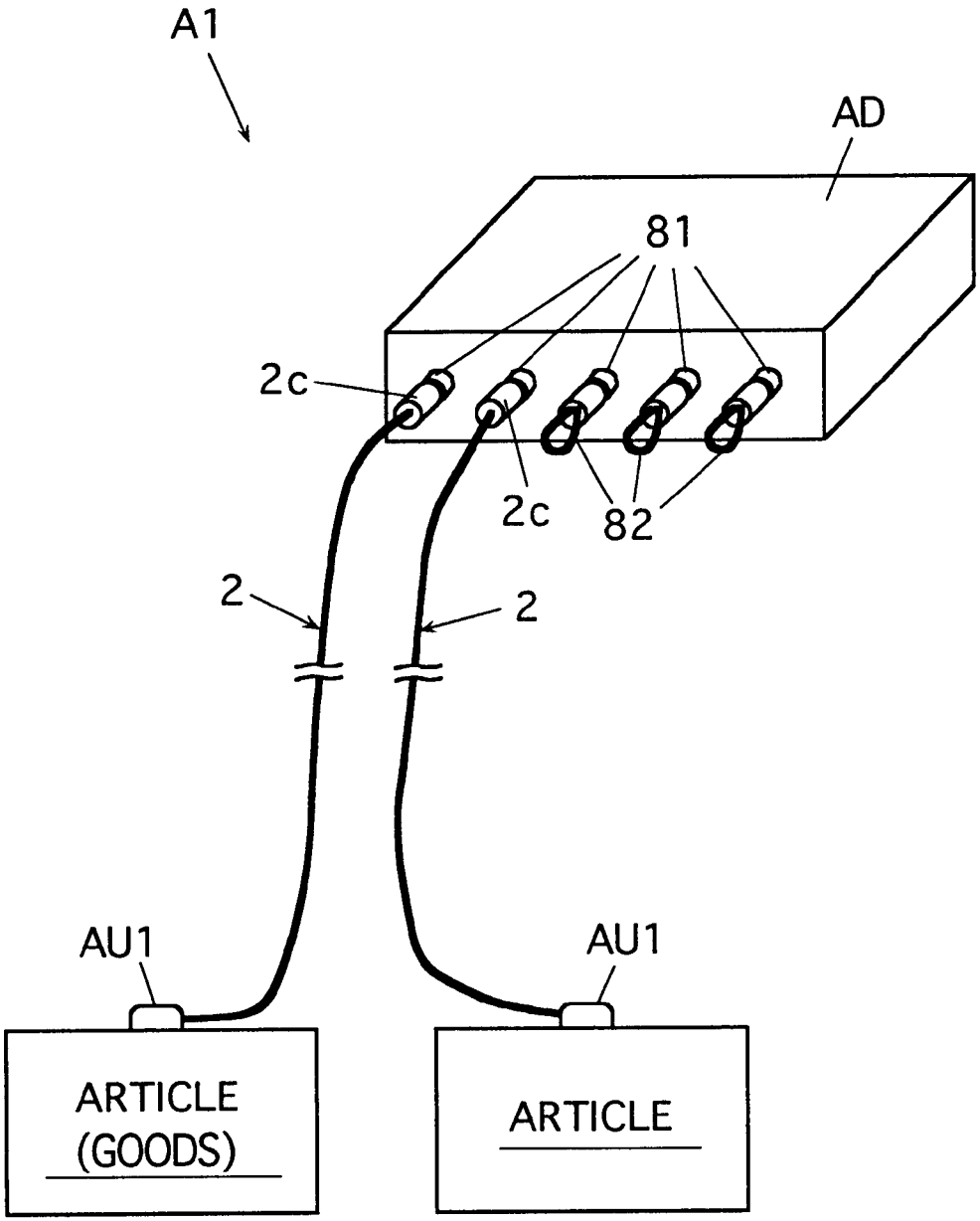
FIG. 1 shows a schematic structure of an example of the shoplifting monitoring apparatus.

In the following description, presented is a shoplifting monitoring apparatus having advantages described later.

§1.1.

The shoplifting monitoring apparatus is provided with an attachment unit (attachment portion) and an alarm device.

The attachment unit is to be attached to an article (monitoring target article) to be monitored for prevention of shoplifting. A predetermined surface of the attachment unit is to be attached to the monitoring target article. More specifically, the attachment unit is to be attached to the monitoring target article such that the predetermined surface of the attachment unit faces the article. This predetermined surface of the attachment unit is referred to as "attachment surface" hereinafter. The attachment unit may be attached to the article, e.g., with a double-sided adhesive tape.

The attachment unit includes a switch (detection switch) for detecting an attached state of the attachment unit to the monitoring target article, that is, whether the attachment unit is attached to the article or not. The attachment unit may further include a hollow casing (cover casing), in which case at least a part of the switch may be arranged inside the casing.

The switch has a movable piece and a contact that selectively takes an open state or a closed state in accordance with a position of the movable piece, more specifically, in accordance with the position of the movable piece with respect to a body of the switch.

The movable piece is supported such that the movable piece can move in a direction from an inside toward an outside of the attachment surface and in a reverse direction thereof. The outside and inside of the attachment surface are sides of the attachment surface nearer to and remoter from the article, respectively, when the attachment unit is attached to the article. The movable piece is biased toward the outside of the attachment surface, typically the movable piece may be biased to be pushed toward the outside of the attachment surface. The movable piece may be biased toward the outside of the attachment surface, e.g., with an elastic member. The elastic member may be a spring such as a coiled spring or plate spring (leaf spring), or a rubber member.

The movable piece may have a rod-like form, and may be configured to move linearly between the inside and outside of the attachment surface. Instead of this, the movable piece may be configured to swing around a predetermined axis between the inside and outside of the attachment surface.

The contact of the switch takes the closed state when the movable piece is pushed toward the inside of the attachment surface so that the movable piece is located or positioned at an inside of a predetermined standard position (predetermined reference position), in other words, when the movable piece is positioned at a closer side to the switch body than the predetermined standard position. On the other hand, the contact of the switch takes the open state when the movable piece is positioned at the predetermined standard position or at an outside of the predetermined standard position.

The attachment unit is to be attached to the article such that the movable piece is pushed by the article toward the inside of the attachment surface so that the movable piece is positioned at the inside of the predetermined standard position to close the contact of the switch.

By attaching the attachment unit to the monitoring target article as described above, if the attachment unit is removed from the article, the force from the article pushing the movable piece toward the inside of the attachment surface, normally, becomes not to act on the movable piece so that the movable piece normally moves to the predetermined standard position or to the outside of the standard position due to the biasing force, and thereby the contact of the switch normally becomes open. According to these, the switch can detect whether the attachment unit is attached to the monitoring target article or not. Information thus detected by the switch is sent to the alarm device.

The alarm device issues the alarm at least when the contact of the switch is in the open state. The alarm device may continue to issue the alarm even if the contact becomes closed after the contact has become open unless and until a predetermined operation is conducted. The alarm may be sound, light and/or others. The alarm device may include an alarm element such as a buzzer issuing sound as the alarm, a lamp issuing light as the alarm or others. The alarm element may be arranged at the attachment unit.

§1.2.

The attachment unit of the shoplifting monitoring apparatus includes, in addition to the switch, a sleeve member as follows.

The sleeve member has a sleeve portion that surrounds an end portion, facing the article, of the movable piece of the switch when the attachment unit is attached to the article. The end portion of the movable piece of the switch and also the sleeve portion face the article when the attachment unit is attached to the article. The sleeve portion may be typically in contact with or close to the article when the attachment unit is attached to the article.

The sleeve portion surrounds the end portion of the movable piece to allow the movable piece to be in contact with the article when the attachment unit is attached to the article, more specifically, to allow the article to push the movable piece toward the inside of the attachment surface, further more, to allow the movable piece to move in the direction from the inside toward the outside of the attachment surface and in the reverse direction thereof.

The sleeve portion may have a cylindrical form, in which case the movable piece may be arranged inside the sleeve portion. A section form of the cylindrical form sleeve portion may be, e.g., circular, rectangular or others.

At least a part of the switch and at least a part of the sleeve member may be arranged inside the hollow casing. In this case, a predetermined surface of the casing may provide the attachment surface, and the sleeve portion of the sleeve member may project outward from the attachment surface (the predetermined surface of the casing) when the attachment unit is attached to the article.

Each of the sleeve member and the switch (switch body) is supported such that each of them can move in the direction from the inside toward the outside of the attachment surface and in the reverse direction thereof. The switch moves together with the sleeve member when the sleeve member is pushed toward the inside of the attachment surface.

The sleeve member and the switch may be fixed to each other, e.g., with an adhesive material. The sleeve member and the switch may not be fixed to each other if the switch can move together with the sleeve member when the sleeve member is pushed toward the inside of the attachment surface as described above.

The sleeve member and/or the switch may be typically biased toward the outside of the attachment surface, and may be biased to be pushed toward the outside of the attachment surface. The sleeve member and/or the switch may be biased toward the outside of the attachment surface, e.g., by an elastic member. The elastic member may be a spring such as a coiled spring or plate spring (leaf spring), or a rubber member. The sleeve member may project outward from the attachment surface when an external force does not act on the sleeve member. In the case where a biasing force toward the outside of the attachment surface always acts on the sleeve member, the sleeve member may project outward from the attachment surface when an external force except the biasing force does not act on the sleeve member. The movable piece of the switch may typically project outward from the attachment surface, and may project outward from the sleeve member when an external force except the biasing force does not act on the movable piece.

§1.3.

The attachment unit is to be attached to the monitoring target article such that the contact of the switch takes the closed state as described above.

After thus attaching the attachment unit to the article, if the attachment unit is removed from the article, the movable piece of the switch moves, due to the biasing force, to the predetermined standard position or outside of the predetermined standard position, and thereby the contact of the switch becomes open unless an external force that prevents this movement of the movable piece toward the outside of the attachment surface acts on the movable piece. According to this, the alarm device starts to issue the alarm. The alarm thus issued can prevent or suppress the theft or shoplifting of the article.

After the attachment unit is attached to the article, the end portion, facing the article, of the movable piece of the switch is surrounded by the sleeve portion of the sleeve member. According to this, if a shoplifter inserts a thin plate such as a cutting knife between the attachment unit and the article to hold the movable piece of the switch for making such a situation that the movable piece does not move toward the outside of the attachment surface even when the attachment unit is removed from the article, in other words, for making such a situation that the contact of the switch does not become open even when the attachment unit is removed from the article, the movement or invasion of the thin plate toward the movable piece can be blocked by the sleeve portion of the sleeve member.

If the inserted thin plate eludes the blocking of the sleeve portion so that the thin plate is further inserted toward the movable piece, the sleeve member is pushed by the thin plate toward the inside of the attachment surface so that the switch itself is pushed together with the sleeve member toward the inside of the attachment surface. According to this, the distance between the switch body and the article surface that has pushed the movable piece of the switch toward the inside of the attachment surface becomes longer, and thereby the movable piece moves toward the outside of the attachment surface. According to this, if the movable piece moves to the predetermined standard position or outside of the predetermined standard position, the contact of the switch becomes open, which means the insertion of the thin plate between the attachment unit and the article is detected by the switch. Based on the information detected by the switch, the alarm device issues the alarm. Therefore, the shoplifting monitoring apparatus can work against the above shoplifter's act for a malicious purpose.

§2. ATTACHMENT UNIT

An attachment unit utilized in the shoplifting monitoring apparatus is described below.

The attachment unit is as follows: an attachment unit utilized in a shoplifting monitoring apparatus and to be attached to an article such that a predetermined attachment surface of the attachment unit faces the article, the attachment unit including: a switch provided for detecting whether the attachment unit is attached to the article or not, the switch including: a movable piece biased toward an outside of the attachment surface; and a contact that is in an open state or a closed state in accordance with a position of the movable piece, the contact being in the closed state when the movable piece is pushed toward an inside of the attachment surface so that the movable piece is located at an inside of a predetermined standard position, the contact being in the open state when the movable piece is located at the predetermined standard position or at an outside of the predetermined standard position; and a sleeve member having a sleeve portion that surrounds an end portion of the movable piece when the attachment unit is attached to the article, the end portion of the movable piece facing the article when the attachment unit is attached to the article; wherein the attachment unit is to be attached to the article such that the movable piece is pushed toward the inside of the attachment surface, and thereby the contact of the switch is in the closed state; each of the sleeve member and the switch is supported such that each of the sleeve member and the switch can move in a direction from the inside toward the outside of the attachment surface and in a reverse direction thereof; and the switch moves together with the sleeve member toward the inside of the attachment surface when the sleeve member is pushed toward the inside of the attachment surface.

The matter described in the section §1. in relation to the attachment unit is also true of the above attachment unit.

With this attachment unit, such a situation can be suppressed by the sleeve member that the movable piece is held, by the thin plate inserted between the attachment unit and the article, so that the movable piece cannot move toward the outside of the attachment surface. When the thin plate is inserted between the attachment unit and the article, the insertion of the thin plate can be detected by the switch before the movable piece is held by the thin plate so that the movable piece cannot move toward the outside of the attachment surface. This is because the switch itself is pushed by the thin plate together with the sleeve member so that the contact of the switch becomes open.

The attachment unit may further include a cord (cable) for sending the information detected by the switch to the alarm device. The attachment unit may further include a casing for accommodating at least a part of the switch and at least a part of the sleeve member.

§3

With reference to drawings, the preferred embodiments of the shoplifting monitoring apparatus and the attachment unit are given below.

FIG. 1 is a schematic view showing a structure of an example of the shoplifting monitoring apparatus.

A shoplifting monitoring apparatus A1 shown in FIG. 1 has an alarm device AD and attachment units (attachment portions) AU1. The apparatus Al has two attachment units AU1 in this example.

Each of the attachment units AU1 is to be attached to an article (monitoring target article) to be monitored for preventing the article from being shoplifted.

The alarm device AD issues an alarm based on information detected by any of the attachment units AU1. As described later in detail, the alarm device AD issues the alarm, e.g., when the attachment unit AU1 is removed from the article. The information detected by the attachment unit AU1 is sent to the alarm device AD through a cord 2 extending from the attachment unit AU1. The cord 2 is provided at its end portion with a connector 2*c* that is fittable to any of connectors 81 of the alarm device AD. The cord 2 can therefore be connected easily to the alarm device AD with the connector 2*c*.

§3.1.

Figure 2A:
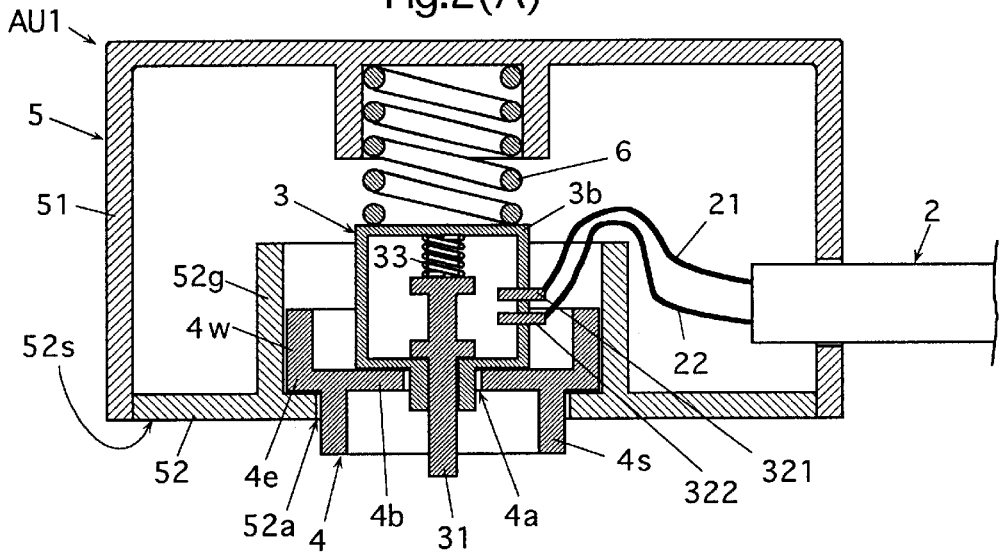
FIGS. 2(A)–2(C) are schematic section views of an example of the attachment unit, respectively. More specifically.

FIGS. 2(A) is a schematic section view of the attachment unit AU1. The attachment unit AU1 has a switch 3 for detecting whether the attachment unit AU1 is attached to the monitoring target article or not. The attachment unit AU1 further has a sleeve member 4 and a casing 5 for accommodating the switch 3 and the sleeve member 4.

The casing 5 is composed of upper and lower casing portions 51 and 52. The upper and lower casing portions are connected to each other by their nail portions (not shown). The attachment unit AU1 is to be attached to the article such that an outer surface 52*s* of the lower casing portion 52 faces the article. The outer surface 52*s* of the lower casing portion 52 is referred to as "attachment surface" hereinafter.

Figure 3A:
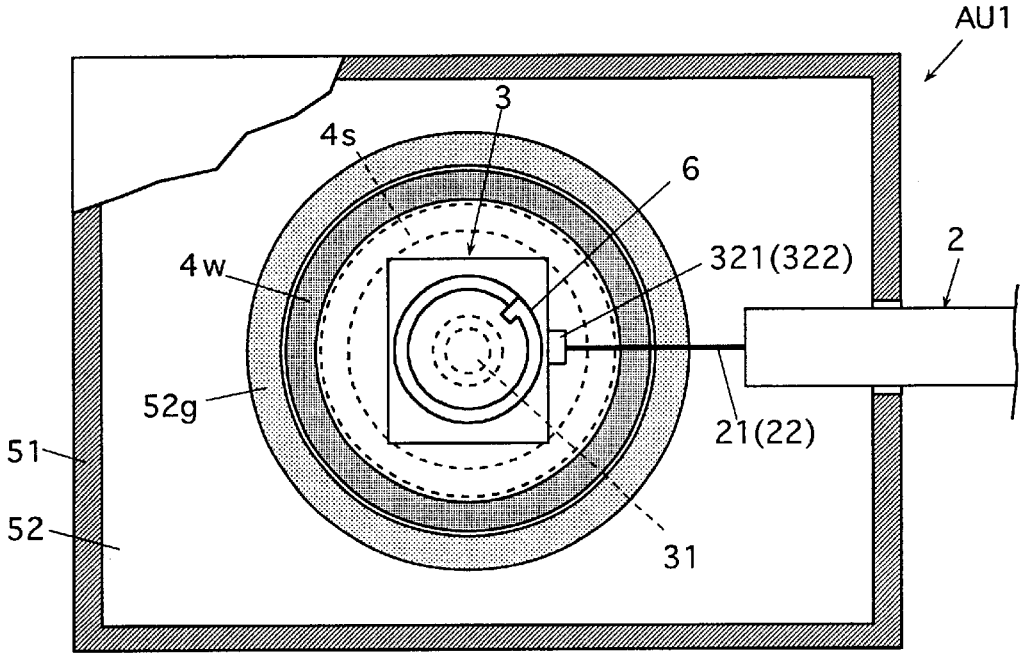
FIG. 3(A) is a schematic plan of the attachment unit of FIG. 2(A) viewed from a reverse side of the attachment surface.
Figure 3B:
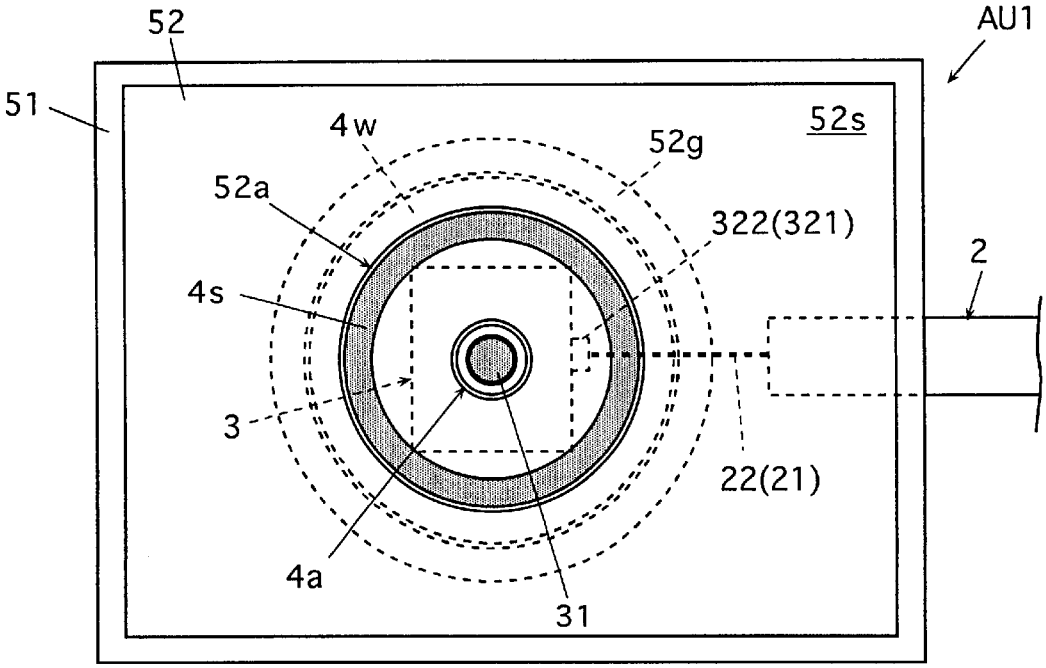
FIG. 3(B) is a schematic plan of the same attachment unit viewed from a side of the attachment surface.

FIGS. 3(A) and 3(B) are schematic plan views of the attachment unit AU1. More specifically, FIG. 3(B) is a plan of the attachment unit AU1 viewed from a side of the attachment surface 52*s*, and the attachment unit AU1 viewed from the reverse side is shown in FIG. 3(A). In FIG. 3(A), a part of the upper casing 51 is removed for showing inside the casing.

A guide wall 52*g* having a circular cylindrical form stands inside the lower casing 52, and the sleeve member 4 is fitted into inside the guide wall 52*g*. The sleeve member 4 is provided with a wall portion 4w having a circular cylindrical form. The wall portion 4*w* of the sleeve member 4 stands on a base portion 4*b* of the sleeve member 4 toward inside the casing, and faces the guide wall 52*g*. Inside the cylindrical wall portion 4*w*, the switch 3 is arranged. In this example, the switch 3 and the sleeve member 4 are connected or fixed to each other with an adhesive material. The switch 3 and the sleeve member 4 can therefore move together with each other.

Figure 2B:
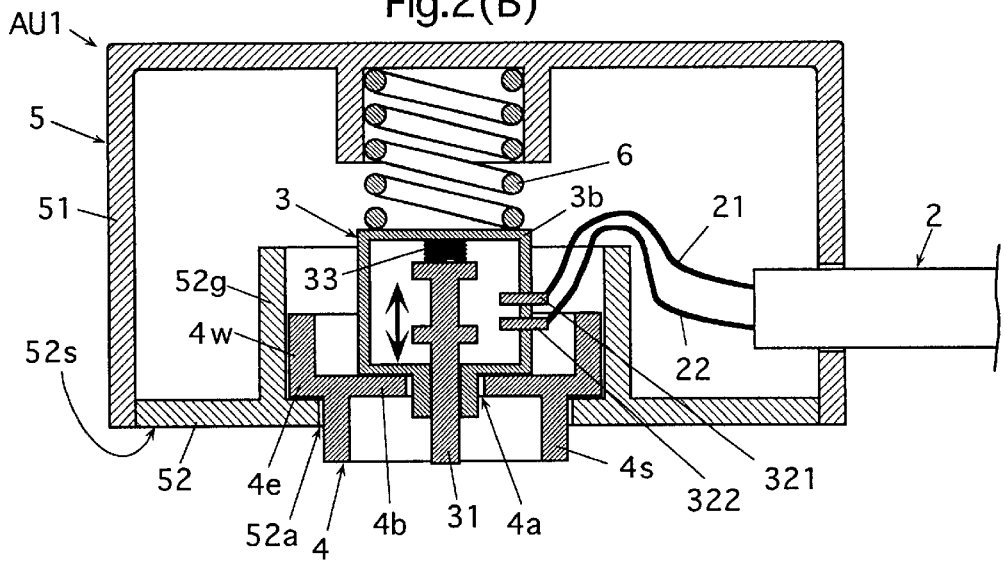
Figure 2C:
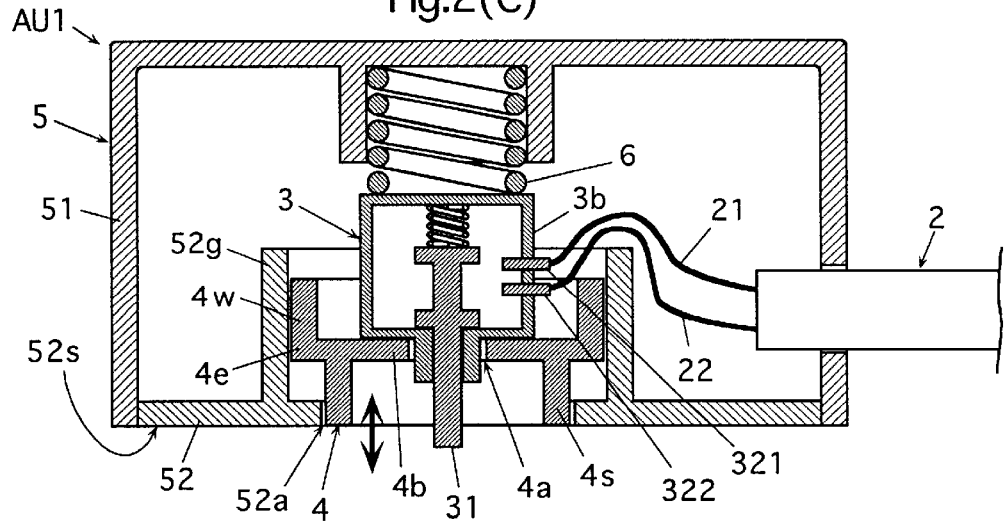

As the wall portion 4*w* of the sleeve member 4 is guided by the guide wall 52*g*, the sleeve member 4 and the switch 3 can move together, as shown in FIGS. 2(A) and 2(C), in a direction from an outside to inside of the attachment surface 52*s* and in a reverse direction thereof (in a direction from an outside to inside of the casing and in a reverse direction thereof), that is, the sleeve member 4 and the switch 3 can move together in both up and down directions in FIG. 2(A).

A coiled spring 6 is arranged between the switch 3 and an inner wall of the upper casing portion 51, and the spring 6 pushes both the switch 3 and the sleeve member 4 toward the outside of the attachment surface 52*s* (toward down direction in the figure). That is, the switch 3 and the sleeve member 4 are biased toward the outside of the attachment surface 52*s*. The sleeve member 4 can move to a position where an edge portion 4*e* of the sleeve member 4 is in contact with the lower casing portion 52.

The sleeve member 4 is further provided with a sleeve portion 4*s* having a circular cylindrical form. The sleeve portion 4*s* of the sleeve member 4 stands on the base portion 4*b* toward the outside of the attachment surface 52*s*. The sleeve portion 4*s* projects outward from the attachment surface 52*s*, as shown in FIG. 2(A), through an aperture 52*a* of the lower casing portion 52 when an external force except a biasing force by the spring 6 does not act on the sleeve member 4.

Figure 4:
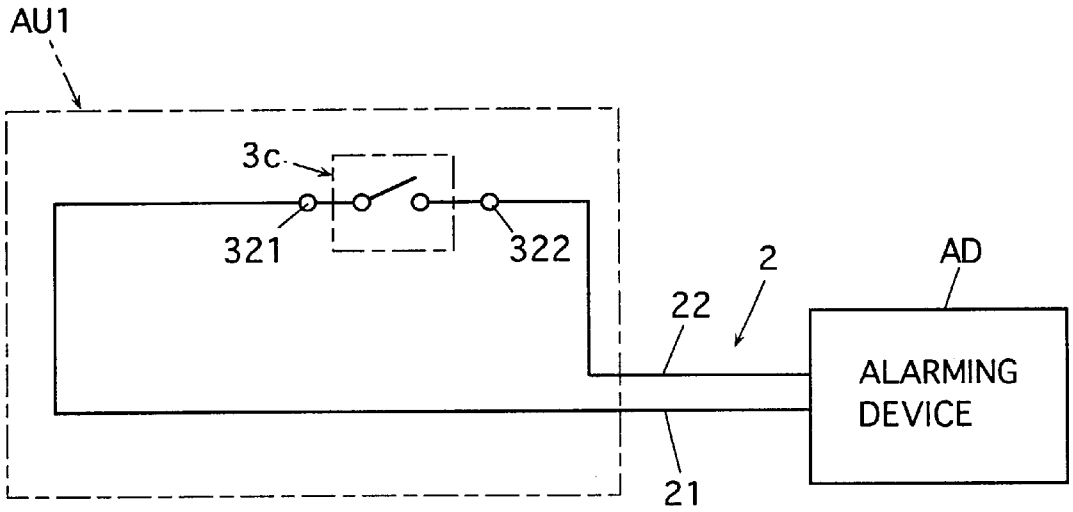
FIG. 4 shows a circuit diagram of the contact of the switch of the attachment unit.

The switch 3 has a movable piece 31 and a contact 3*c* (see FIG. 4) that is opened or closed in accordance with a position of the movable piece 31 with respect to a switch body 3*b*. In FIGS. 2(A)–2(C) and other figures except FIG. 4, the contact 3*c* of the switch is not illustrated. The contact 3*c* is arranged inside the switch body 3*b*.

As shown in FIGS. 2(A) and 2(B), the movable piece 31 can move with respect to the switch body 3*b* in the direction from the inside to outside of the attachment surface 52*s* and in the reverse direction thereof (in the direction from the inside to outside of the casing and in the reverse direction thereof), that is, the movable piece 31 can move in both up and down directions in FIGS. 2(A) and 2(B). The movable piece 31 is pushed by a spring 33 toward the outside of the attachment surface 52*s*. By the biasing force of the spring 33, the movable piece 31 projects outward from the attachment surface 52*s* (outward from the casing) through an aperture 4*a* of the base portion 4*b* of the sleeve member 4, and further projects outward from the sleeve portion 4*s* when an external force except the biasing force of the spring 33 does not act on the movable piece 31.

The contact 3*c* is opened or closed by already known mechanism (not shown) in accordance with the position of the movable piece 31 with respect to the switch body 3*b*. The contact 3*c* of the switch 3 is in a closed state when the movable piece 31 is positioned at an inside of a predetermined standard position, that is, when the movable piece is located in a position closer to the switch body 3*b* than the predetermined standard position. The contact 3*c* of the switch is in an open state when the movable piece 31 is positioned at the predetermined standard position or at an outside of the predetermined standard position.

Respective ends of the contact 3*c* of the switch 3 are connected to outer-leads 321 and 322. Open-closed state information of the contact 3*c* is sent to the alarm device AD with lead wires 21 and 22, connected to the respective outer-leads 321 and 322, of the cord 2.

§3.2.

A using manner of the shoplifting monitoring apparatus A1 is given below.

Figure 5:
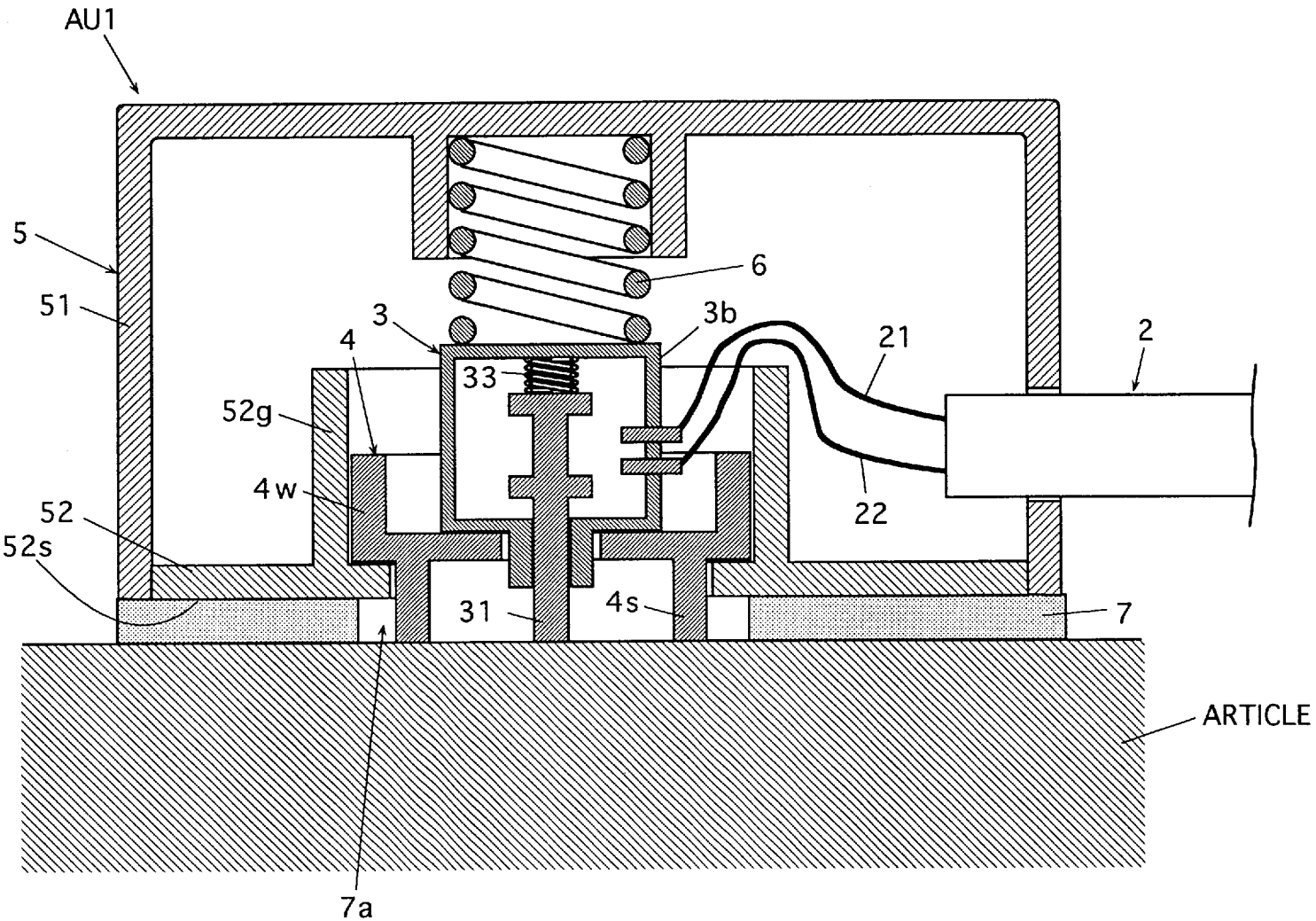
FIG. 5 shows an example of the state that the attachment unit of FIG. 2(A) is attached to the article, more specifically the state that the sleeve portion of the sleeve member is in contact with the article.

For monitoring the article, the attachment unit AU1 is attached to the article, as shown in FIG. 5, with a double-sided adhesive tape 7 in this example.

The attachment unit AU1 is attached to the article such that the attachment surface 52*s* faces the article. By attaching the attachment unit AU1 to the article, the movable piece 31 of the switch 3 is in contact with the article surface through an aperture 7*a* of the tape 7, and thereby the movable piece 31 is pushed by the article surface toward the inside of the casing 5 to close the contact 3*c* of the switch 3. This state is referred to as an initial state. In the initial state, an end portion, facing the article, of the movable piece 31 of the switch 3 is surrounded by the sleeve portion 4*s* of the sleeve member 4, and the alarm device does not issue the alarm.

In this example, spring modulus of the spring 6 pushing the switch 3 and the sleeve member 4 toward the outside of the casing is set to be larger than that of the spring 33 pushing the movable piece 31 of the switch 3 toward the outside of the casing. Further, an outward projected length of the sleeve portion 4*s* of the sleeve member 4 from the attachment surface 52*s* is set to be approximately. same as a thickness of the double-sided adhesive tape 7 in this example. According to these, each of the positions of the switch 3 and the sleeve member 4 with respect to the casing 5 is not substantially changed before and after the attachment unit AU1 is attached to the article. The movable piece 31 is therefore pushed toward the inside of the casing when the attachment unit AU1 is attached to the article so that the contact 3*c* of the switch becomes closed.

Figure 6:
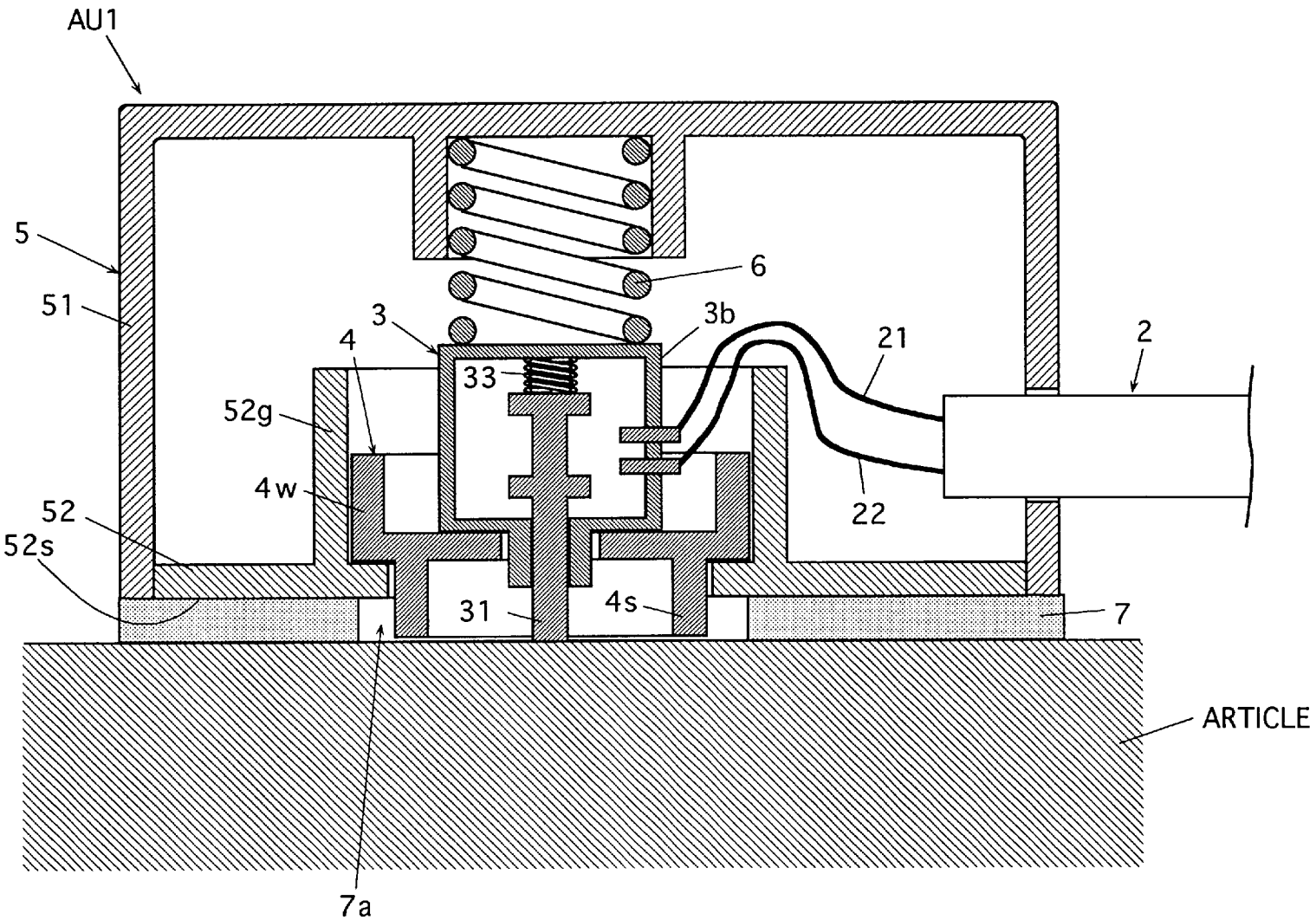
FIG. 6 shows another example of the state that the attachment unit of FIG. 2(A) is attached to the article, more specifically the state that the sleeve portion of the sleeve member is close to the article.

The sleeve portion 4*s* of the sleeve member 4 is in contact with the article surface when the attachment unit is attached to the article. The sleeve portion 4*s* of the sleeve member 4 may not be in contact with the article, and may be close to the article as shown in FIG. 6 when the attachment unit AU1 is attached to the article.

If the attachment unit AU1 in the initial state is removed from the monitoring target article, the removal of the attachment unit from the article is, normally, detected by the switch 3 in the following way so that the alarm device issues the alarm. The movable piece 31 of the attachment unit removed from the article moves toward the outside of the casing 5 due to the biasing force by the spring 33 since the force that has been pushing the movable piece 31 toward the inside of the casing no longer acts on the movable piece 31 when the attachment unit is removed from the article. According to this, the contact 3*c* of the switch 3 of the attachment unit AU1 removed from the article opens when the attachment unit AU1 is removed from the article. In this way, the open-closed state of the contact 3*c* of the switch 3 changes from the closed state to the open state when the attachment unit AU1 is removed from the monitoring target article, which means the removal of the attachment unit AU1 from the article is detected.

The information detected by the switch 3 is sent to the alarm device AD through the lead wires 21 and 22 of the cord 2. The alarm device AD issues the alarm based on the information detected by the switch. More specifically, the alarm device AD issues the alarm when the contact 3*c* of the switch of at least one of the attachment units AU1 is in the open state. The alarm device AD issues the alarm of sound and light in this example. This alarm can suppress the shoplifting of the article.

§3.4.

The shoplifting monitoring apparatus A1 has advantages as follows due to the sleeve member 4.

In the shoplifting monitoring apparatus A1, as described above, the switch 3 detects whether the attachment unit AU1 is attached to the monitoring target article or not, and the alarm device AD issues the alarm when the removal of the attachment unit AU1 from the article is detected by the switch 3. When the attachment unit AU1 is removed from the article, the movable piece 31 of the switch normally moves to the outside of the casing so that the contact 3*c* of the switch becomes open, and therefore the removal of the attachment unit AU1 from the article is detected.

The shoplifter might insert a thin plate, e.g., cutting knife, between the attachment unit AU1 and the article, before removing the attachment unit AU1 from the article, to hold the movable piece 31 of the switch not to move toward the outside of the casing, for making such a situation that the contact 3*c* of the switch does not become open even when the shoplifter removes the attachment unit AU1 from the article, in other words, for making such a situation that the alarm is not issued even when the shoplifter removes the attachment unit AU1 from the article.

Even if the thin plate is inserted between the attachment unit AU1 and the article, the movement or invasion of the thin plate toward the movable piece 31 can be blocked by the sleeve portion 4*s* of the sleeve member 4 since the movable piece 31 is surrounded by the sleeve portion 4*s*.

Figure 7:
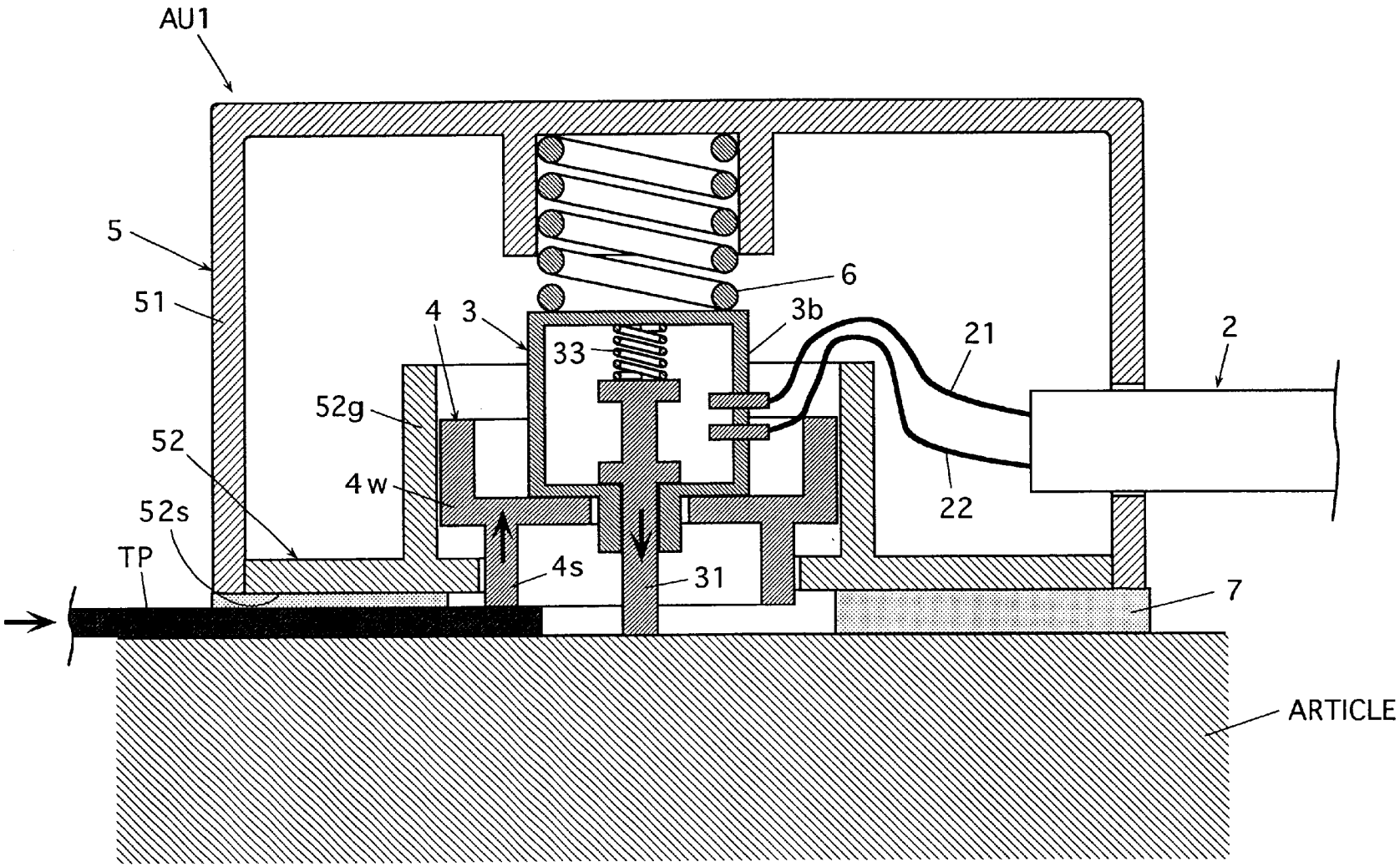
FIG. 7 shows such a situation that a thin plate is inserted between the attachment unit and the article, and the sleeve member and the switch of the attachment unit are pushed toward the inside of the attachment surface.

When the thin plate TP eludes, as shown in FIG. 7, the blocking of the sleeve portion 4*s* so that the thin plate TP is further inserted toward the movable piece 31, the sleeve member 4 is pushed by the thin plate TP toward the inside of the casing so that the switch 3 is pushed together with the sleeve member 4 toward the inside of the casing, and thereby the distance between the switch body 3*b* and the article becomes larger than that in the initial state. According to this, if the movable piece 31 of the switch 3 moves to the predetermined standard position or outside of the predetermined standard position, the contact 3*c* of the switch 3 becomes open. As a result, the alarm device AD issues the alarm.

Of course, the alarm device AD issues the alarm when the attachment unit AU1 is separated from the article during the shoplifter's act of inserting the thin plate between the attachment unit AU1 and the article.

In the shoplifting monitoring apparatus A1, as described above, the sleeve member 4 can block the insertion of the thin plate even if the shoplifter inserts the thin plate between the attachment unit AU1 and the article for holding the movable piece 31 not to move. Further, if the sleeve member 4 is lifted up by the thin plate so that the contact 3*c* of the switch becomes open, the alarm device AD issues the alarm. According to these, the shoplifting monitoring apparatus A1 can further suppress the shoplifting of the monitoring target article than the conventional apparatus.

§4

Figure 8:
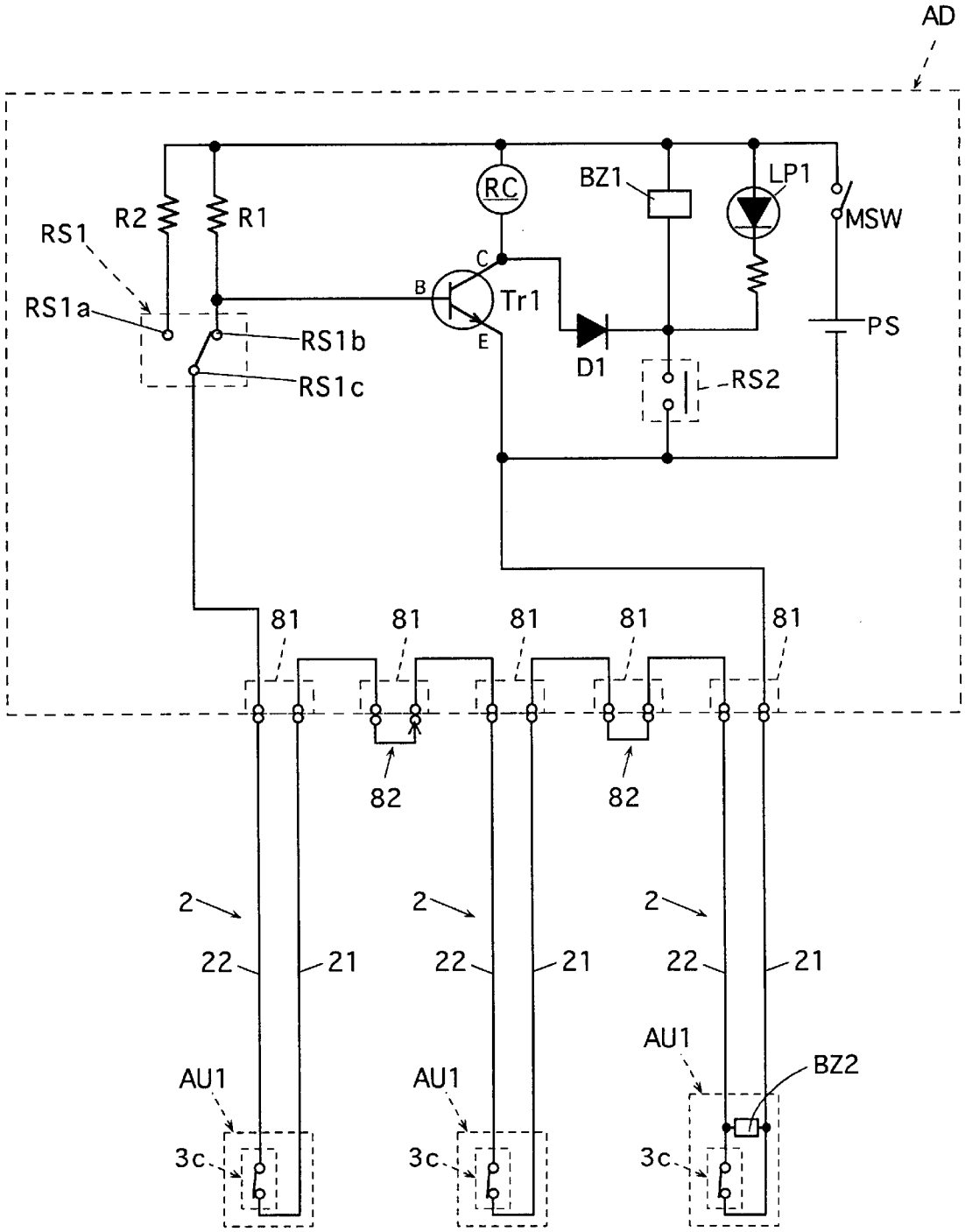
FIG. 8 shows a circuit diagram of an example of the alarm device.

FIG. 8 shows an example of a circuit diagram of the alarm device AD.

The alarm device AD of FIG. 8 has a buzzer BZ1 and a light-emitting diode lamp LP1 both serving as the alarming elements as well as a drive circuit for driving the alarming elements based on the information sent from the attachment unit AU1.

The alarm device AD has, in this example, five female connectors 81 each for connection with the cord 2 extending from the attachment unit AU1. A male connector (not shown) corresponding to each female connector 81 of the alarm device AD is provided at an end portion, to be connected to the alarm device AD, of the cord 2, and therefore the cord 2 can be connected easily to the alarm device AD. A short-circuit cord 82 is connected to the connector 81 to which the cord 2 is not connected.

In the alarm device AD, an energized state of a relay coil RC and an on-off state of a transistor Tr1 are controlled based on the contact state of each of the attachment unit AU1, so that the open-closed states of relay contacts RS1 and RS2 are controlled. According to this, application of a voltage to the alarming element from a power source PS is controlled.

Each of the relay contacts RS1 and RS2 is opened or closed according to the energized state of the relay coil RC. The relay contact RS1 has three terminals RS1*a*, RS1*b* and RS1*c*. The terminal RS1*c* is a common terminal. The terminals RS1*a* and RS1*c* form a normally open contact, and the terminals RS1*b* and RS1*c* form a normally closed contact. The relay contact RS2 is a normally open contact.

For putting the alarm device AD to use, each of the attachment units AU1 is attached to the article so that the switch contact 3*c* is closed, and thereafter a main switch MSW is closed. In this initial state, the transistor Tr1 is off, the relay coil RC is not energized and the relay contact RS2 is open. Consequently a voltage is not applied from the power source PS to the buzzer BZ1 and lamp LP1 serving as the alarming elements, so that the alarm is not issued.

When the contact 3*c* of at least one of the attachment units AU1 in the initial state becomes open, then the transistor Tr1 is on, the relay coil RC is energized, the relay contact RS2 is closed, and finally a voltage is applied to the buzzer BZ1 and the lamp LP1. Thereby the buzzer BZ1 and the lamp LP1 start to issue the alarms. When the relay coil RC is once energized, the buzzer BZ1 and the lamp LP1 continue to issue the alarm even if the transistor Tr1 becomes off since the energized state of the relay coil RC is maintained by its contact RS2 connected in series to the relay coil RC and the power source PS. The alarm device continues to issue the alarms until the main switch MSW is off.

Alarms are also raised, for example, when the lead wires 21 and/or 22 of the cord 2 in the initial state are cut off, or when the cord 2 in the initial state is pulled out of the connector 81 of the alarm device AD.

The alarming element (buzzer BZ2 in this example) may be connected in parallel to the contact 3*c* of the switch, as is done in the rightmost attachment unit AU1 in FIG. 8. According to this, a voltage is not applied to the buzzer BZ2 when the contact 3*c* is closed, and therefore the alarm is not issued from the buzzer BZ2. When the contact 3*c* is open, a voltage is applied to the buzzer BZ2 from the power source PS via a resistance R2, and thereby the buzzer BZ2 issues the alarm.

If the alarming element is arranged at the attachment unit as described above, the alarm is issued on the spot of shoplifting. More specifically, the alarm is raised in the very hand of the shoplifter who has detached the attachment unit from the article. The theft or shoplifting of the article would be more likely to be prevented in the case of giving the alarm in the very hand of the shoplifter, compared with the case where the alarm is raised in a position little apart from the shoplifter. Further, the alarm can let the shoplifter know that the act of shoplifting is detected.

Of course, the alarm may be given at a position (e.g. at a location remote from an area of displaying articles) where the shoplifter cannot become aware of the alarm.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A shoplifting monitoring apparatus comprising:

(A) an attachment unit to be attached to an article such that a predetermined attachment surface of the attachment unit faces the article, the attachment unit including:

(A1) a switch provided for detecting whether the attachment unit is attached to the article or not, the switch including:

(A11) a movable piece biased toward an outside of the attachment surface; and (A12) a contact that is in an open state or a closed state in accordance with a position of the movable piece, the contact being in the closed state when the movable piece is pushed toward an inside of the attachment surface so that the movable piece is located at an inside of a predetermined standard position, the contact being in the open state when the movable piece is located at the predetermined standard position or at an outside of the predetermined standard position; and (A2) a sleeve member having a sleeve portion that surrounds an end portion of the movable piece when the attachment unit is attached to the article, the end portion of the movable piece facing the article when the attachment unit is attached to the article; and (B) an alarm device issuing an alarm based on information detected by the switch; wherein the attachment unit is to be attached to the article such that the movable piece is pushed by the article toward the inside of the attachment surface, and thereby the contact of the switch is in the closed state;

each of the sleeve member and the switch is supported such that each of the sleeve member and the switch can move in a direction from the inside toward the outside of the attachment surface and in a reverse direction thereof;

the switch moves together with the sleeve member toward the inside of the attachment surface when the sleeve member is pushed toward the inside of the attachment surface; and the alarm device issues the alarm at least when the contact of the switch is in the open state.

2. The shoplifting monitoring apparatus according to claim 1, wherein the switch and the sleeve member are connected to each other such that the switch and the sleeve member can move together with each other.

3. The shoplifting monitoring apparatus according to claim 1, wherein at least one of the switch and the sleeve member is biased toward the outside of the attachment surface.

4. The shoplifting monitoring apparatus according to claim 1, wherein the sleeve portion of the sleeve member is in contact to or close to the article when the attachment unit is attached to the article.

5. The shoplifting monitoring apparatus according to claim 1, wherein the attachment unit further includes a hollow casing, at least a part of the switch and at least a part of the sleeve member are both arranged inside the casing, a predetermined surface of the casing provides the attachment surface, and the sleeve portion of the sleeve member projects outward from the attachment surface when the attachment unit is attached to the article.

6. The shoplifting monitoring apparatus according to claim 1, wherein the attachment unit is to be attached to the article with a double-sided adhesive tape.

7. An attachment unit utilized in a shoplifting monitoring apparatus and to be attached to an article such that a predetermined attachment surface of the attachment unit faces the article, the attachment unit comprising:

(A) a switch provided for detecting whether the attachment unit is attached to the article or not, the switch including:

(A1) a movable piece biased toward an outside of the attachment surface; and (A2) a contact that is in an open state or a closed state in accordance with a position of the movable piece, the contact being in the closed state when the movable piece is pushed toward an inside of the attachment surface so that the movable piece is located at an inside of a predetermined standard position, the contact being in the open state when the movable piece is located at the predetermined standard position or at an outside of the predetermined standard position; and (B) a sleeve member having a sleeve portion that surrounds an end portion of the movable piece when the attachment unit is attached to the article, the end portion of the movable piece facing the article when the attachment unit is attached to the article; wherein the attachment unit is to be attached to the article such that the movable piece is pushed by the article toward the inside of the attachment surface, and thereby the contact of the switch is in the closed state;

each of the sleeve member and the switch is supported such that each of the sleeve member and the switch can move in a direction from the inside toward the outside of the attachment surface and in a reverse direction thereof; and the switch moves together with the sleeve member toward the inside of the attachment surface when the sleeve member is pushed toward the inside of the attachment surface.

8. The attachment unit according to claim 7, wherein the switch and the sleeve member are connected to each other such that the switch and the sleeve member can move together with each other.

9. The attachment unit according to claim 7, wherein at least one of the switch and the sleeve member is biased toward the outside of the attachment surface.

10. The attachment unit according to claim 7, wherein the sleeve portion of the sleeve member is in contact to or close to the article when the attachment unit is attached to the article.

11. The attachment unit according to claim 7, further comprising a hollow casing, wherein at least a part of the switch and at least a part of the sleeve member are both arranged inside the casing, a predetermined surface of the casing provides the attachment surface, and the sleeve portion of the sleeve member projects outward from the attachment surface when the attachment unit is attached to the article.

12. The attachment unit according to claim 7, wherein the attachment unit is to be attached to the article with a double-sided adhesive tape.

* * * * *